US010371490B2

(12) United States Patent
Nester et al.

(10) Patent No.: US 10,371,490 B2
(45) **Date of Patent: *Aug. 6, 2019**

(54) LUBRICATED PROJECTILE TRAP AND SHOOTING RANGE

(71) Applicant: Savage Range Systems, Inc., Westfield, MA (US)

(72) Inventors: Charles E. Nester, Pittsfield, MA (US); Ronald Coburn, Spofford, NH (US)

(73) Assignee: Savage Range Systems, Inc., Westfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/846,772

(22) Filed: Dec. 19, 2017

(65) Prior Publication Data

US 2018/0328700 A1 Nov. 15, 2018

Related U.S. Application Data

(63) Continuation of application No. 15/244,802, filed on Aug. 23, 2016, now Pat. No. 9,846,015, which is a continuation of application No. 14/857,743, filed on Sep. 17, 2015, now Pat. No. 9,423,217.

(60) Provisional application No. 62/051,498, filed on Sep. 17, 2014.

(51) Int. Cl.
*F41J 13/00* (2009.01)
*F41J 11/00* (2009.01)

(52) U.S. Cl.
CPC ..... *F41J 13/00* (2013.01); *F41J 11/00* (2013.01)

(58) Field of Classification Search
CPC ..... F41J 13/00; F41J 13/02
USPC ..... 273/404, 410
See application file for complete search history.

(56) References Cited

U.S. PATENT DOCUMENTS

| | | | | |
|---|---|---|---|---|
| 2,356,992 | A | 8/1944 | Gilson | |
| 2,420,304 | A | 5/1947 | Diem | |
| 2,422,284 | A | 6/1947 | Andresen et al. | |
| 2,631,454 | A | 3/1953 | Shepard et al. | |
| 3,217,534 | A | 11/1965 | Bingham et al. | |
| 5,070,763 | A | 12/1991 | Coburn | |
| 5,113,700 | A | 5/1992 | Coburn | |
| 5,121,671 | A | 6/1992 | Coburn | |
| 5,486,008 | A | 1/1996 | Coburn | |
| 5,564,712 | A | 10/1996 | Werner | |
| 5,718,434 | A | 2/1998 | Alward | |
| 5,811,718 | A | 9/1998 | Bateman | |
| 7,434,811 | B1 | 10/2008 | Coburn et al. | |
| 7,503,250 | B2 | 3/2009 | Lambert et al. | |
| 8,459,651 | B1 | 6/2013 | Nester et al. | |
| 9,423,217 | B2 * | 8/2016 | Nester | F41J 11/00 |
| 9,846,015 | B2 * | 12/2017 | Nester | F41J 11/00 |
| 2007/0210522 | A1 * | 9/2007 | Halverson | F41J 11/00 273/404 |

* cited by examiner

*Primary Examiner* — Mark S Graham
(74) *Attorney, Agent, or Firm* — Christensen, Fonder, Dardi & Herbert PLLC

(57) ABSTRACT

A fluid lubricated projectile trap includes a substantially cylindrical chamber defined by a forward concave wall and a rearward concave wall. A bullet funnel extending forwardly therefrom. The funnel having a lower panel connecting to the forward concave wall in conjunction with an end plate defines a pressurized fluid containment with discharge outlets directed to the rearward concave wall. All plumbing may be secured below the ramp and forward of the chamber.

18 Claims, 6 Drawing Sheets

LUBRICATED PROJECTILE TRAP AND SHOOTING RANGE

RELATED APPLICATIONS

This application is a continuation of U.S. patent application Ser. No. 15/244,802, filed on Aug. 23, 2016, now U.S. Pat. No. 9,846,015, which is a continuation of U.S. patent application Ser. No. 14/857,743, filed on Sep. 17, 2015, now U.S. Pat. No. 9,423,217, which claims the benefit of U.S. Provisional Patent Appl. No. 62/051,498, filed Sep. 17, 2014, all of which are incorporated herein by reference in their entireties.

FIELD OF THE TECHNOLOGY

The present disclosure relates generally to projectile trap shooting ranges and, more particularly, to a fluid lubricated projectile trap for varied uses, including for use in a shooting range.

BACKGROUND

Shooting range projectile traps include various apparatuses for preventing fragments of lead and other metals from escaping the traps and becoming a hazard to health and the environment. A problem associated with these traditional systems and methods is that bullets contact the trap's impact plates at high momentums and at a variety of angles, which invariably ricochet at relatively high angles of incidence and may ultimately impact at a high angle against interior surfaces. Often this results in a shattering and fragmentation of bullets, projectiles, and the like. Further, these systems often suffer from high rates of deterioration of the impact plate wall and other interior surfaces. A still further problem associated with previous conventional systems is the escape of a bullet or its fragments from confinement in the chamber, and may contribute to lead pollution of the environment.

One type of shooting range introduced by the Applicant includes joining individual projectile traps configured as deceleration trap chamber units with fluid systems. These deceleration trap chamber units are often characterized as snail chambers in that in they have a bullet entry funnel opening toward a shooting station with the funnel at the top of a substantially cylindrical chamber, resembling the cross section of a snail shell. The bullet can enter the substantially cylindrical chamber from the funnel and travel somewhat circularly around the inner periphery of the circular chamber until the bullet loses energy. A slot in the bottom of the chamber allows bullets and fragments to fall into a bin below the chamber. The slot is open in a direction opposite that of the bullet travel such that the bullets exit only after they loose velocity and settle to the bottom of the chamber.

The bullet entry funnel has a upper planar funnel panel angled upwardly at an acute angle from horizontal, the upper funnel panel joined in a tangential manner with the top rear chamber wall forming the chamber. A lower funnel planar panel positioned at an acute angle below horizontal forms the other half of the funnel defining a horizontally extending funnel opening. The lower funnel panel is attached to an outer surface of a forward chamber wall that forms the substantially cylindrical chamber. The lower planar funnel panel may also be attached to the forward wall forming the cylindrical chamber in a tangential manner. The lower surface of the lower funnel panel is attached to the outer surface of the forward chamber wall. The lower funnel panel and forward cylindrical chamber defining a space that converges towards and stops at the juncture of the panel and wall.

Additionally Applicant has increased the effectiveness of these systems, particularly with respect to reducing airborne lead dust from bullets, by making the systems "wet". In such systems fluid, such as water and a aqueous oil, are pumped from a reservoir and dispersed on the top surface of the lower funnel panel providing a sheet of downwardly flowing fluid that covers the top surface of the panel. The fluid is collected in a forward sump and then transferred to the reservoir. When bullets strike the top surface of the lower panel, debris is collected in the water to flow to the sump. Moreover, striking the water can take some of the energy from the fired bullet. Additionally, fluid is pumped to the top of the deceleration trap chamber units and dispersed from the juncture of the upper panel and the top rear chamber wall and which are sprayed into the cylindrical chamber from the top of the deceleration trap chamber unit. Such a location requires exposed plumbing on the top of the deceleration trap chamber units and where two or more such units are connected, the plumbing will typically extend the length of the combined units and/or have lines running on top of and behind the units.

Any improvements in the cost and performance of such "wet" systems, or in a reduction in complexity without sacrificing performance would be welcome.

SUMMARY

In accordance with the present disclosure, devices and assemblies are provided for shooting ranges. This disclosure provides improved shooting ranges and projectile traps that are convenient, environmentally-friendly, and safe for the user, particularly when used to decelerate projectiles in trap chambers.

One embodiment of the present disclosure includes an improved projectile trap for a shooting range. The improved projectile trap comprising at least one deceleration trap chamber unit with a forward funnel and with a lubrication system. The funnel has a bullet entry opening toward a shooting station. The funnel is positioned at the top of a substantially cylindrical chamber, resembling the cross section of a snail shell. The bullet can enter the substantially cylindrical chamber from the funnel and travel somewhat circularly around the inner periphery of the circular chamber until the bullet loses energy. A slot in the bottom of the chamber allows bullets and fragments to fall by gravity into a reservoir below the chamber. The slot is open in a direction opposite that of the bullet travel such that the bullets exit only after they lose velocity and settle to the bottom of the chamber. The bullet entry funnel has an upper planar funnel panel angled upwardly at an acute angle from horizontal, the upper funnel panel joined in a tangential manner with the top rear chamber wall forming the cylindrical chamber. A lower funnel planar panel positioned at an acute angle below horizontal forms the other half of the funnel defining a horizontally extending funnel opening. The lower funnel panel is attached to an outer surface of a forward chamber wall that forms the substantially cylindrical chamber. The lower planar funnel panel may also be attached to the forward wall forming the cylindrical chamber in a tangential manner. The lower surface of the lower funnel panel is attached to the outer surface of the forward chamber wall. The lower funnel panel and forward cylindrical chamber defining a pressurized fluid containment with spray outlets positioned in the entry direction of the bullets. A pump is connected to the pressurized fluid containment and the reservoir. The spray from the spray outlets provides a sheet of fluid across the bullet entry to the deceleration trap chamber. The spray then impacts the inside surface of the back wall and flows downwardly to and through the slot and into the fluid reservoir. The fluid flow taking bullet debris including dust and shards with the fluid into the reservoir.

The pressurized fluid containment, in embodiments, is formed by portions of the forward wall of the substantially cylindrical chamber, by a portion of the lower funnel panel, and by an end piece welded to the other two pieces.

A feature and advantage of embodiments of the disclosure is that essentially the entirety of the fluid system plumbing is below the funnels, in front of the deceleration trap chamber units. Thus positioned they are not visible and subject to damage, tampering or the like and present a more aesthetically pleasing product.

BRIEF DESCRIPTION OF THE DRAWINGS

Embodiments of the disclosure will be better understood by a reading of the Description of Embodiments along with a review of the drawings, in which.

DESCRIPTION OF THE EMBODIMENTS

Figure 1:
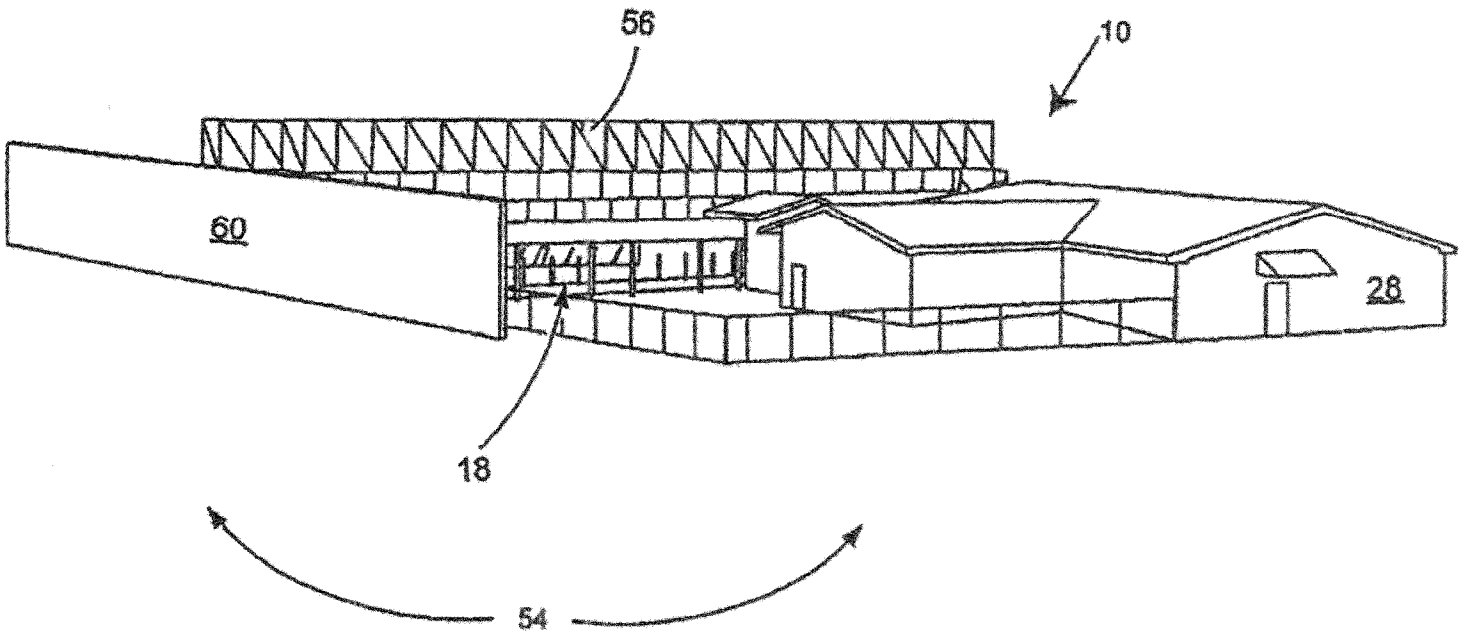
FIG. 1 is a top perspective view of one embodiment of a shooting range.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 3A:
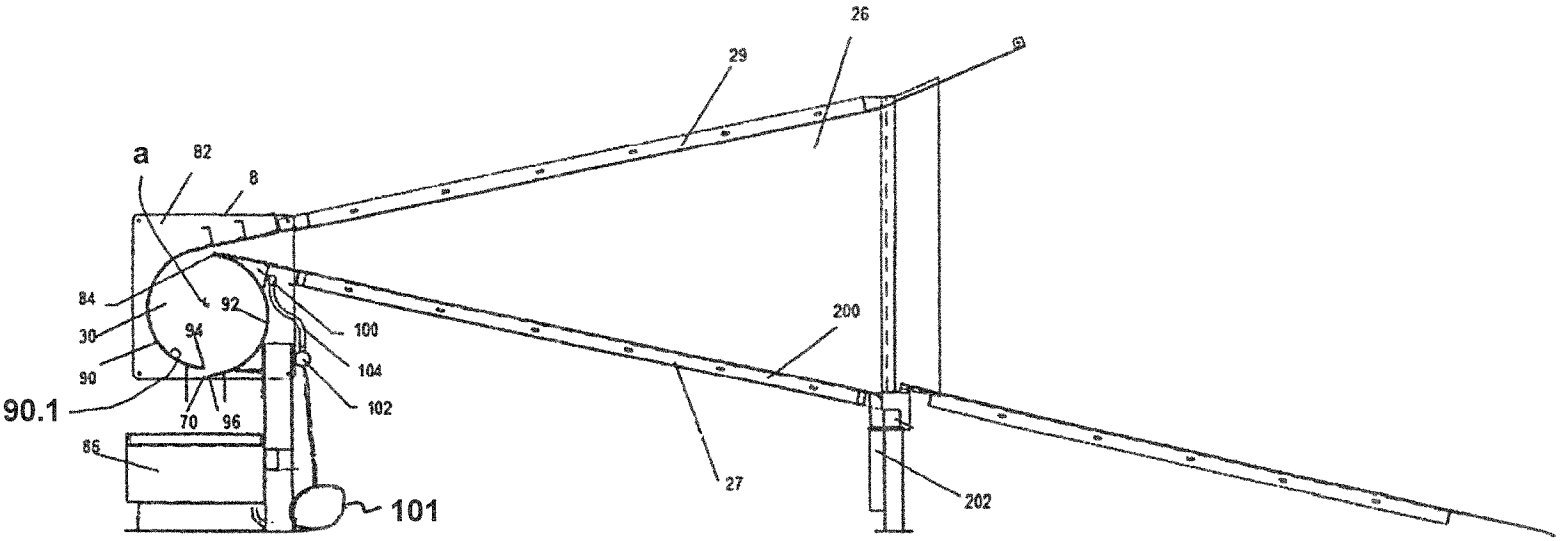
FIG. 3A is an enlarged cross-section side view of a wet projectile trap embodiment for use in the shooting range of the present inventions.

Referring now to the drawings in general and FIG. 1 in particular, it will be understood that the illustrations are for the purpose of describing a preferred embodiment of the invention and are not intended to limit the invention thereto. As best seen in FIGS. 1 and 3A, a shooting range, generally designated 10, is shown constructed according to the present inventions having a fluid lubricated deceleration trap chamber unit 82. The shooting range 10 may include an administrative facility 28 having a safety area where firearms may be inspected and readied. In addition, range management may have offices adjacent or in the safety area. Limited access to the shooting range 10 may be provided by additional fencing and supplemented, in part, by a containment system, generally designated 54. The term fluid used herein may refer to any liquid or fluid discharged in the systems and assemblies, including, but not limed to, any water, solution, or the like generally described or shown in "Design Criteria for Shooting Ranges" by C. Vargas, Third National Shooting Range Symposium (1996); Army 20 Regulation AR 385-63 "Range Safety"; Navy Handbook (MIL-HDBK) 1027/3B, "Range Facilities and Miscellaneous Training Facilities Other Than Buildings" and the National Rifle Association's "NRA Range Source Book." These references are hereby incorporated by reference in their entireties.

Figure 2:
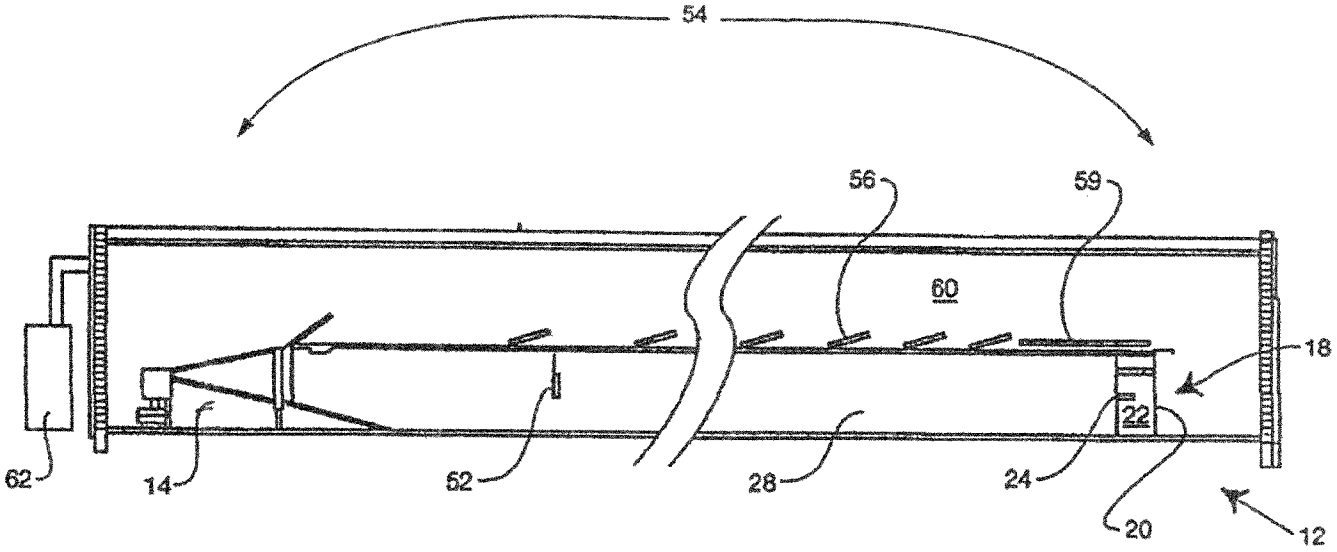
FIG. 2 is a cross-sectional side view of a portion of the shooting range introduced in FIG. 1.

FIG. 2 is a cross-sectional view of a portion of shooting range 10. FIG. 2 shows a shooting station 12, a projectile trap 14 and at least one range auxiliary system that may include: a targeting system 52; a containment system 54 that may optionally include one or more sidewalls, such as the wall 60, overhead baffles 56, and or a safety ceiling 59, or a heating ventilation air conditioning (HVAC) system 62 and combinations thereof. The shooting station 12 may include one or more of a firing position 18 and a 30 shooting booth 20 that may optionally include a weapon rest 24 and or a lane divider 22.

FIG. 3A shows a shooting station with one embodiment of a funnel 26 for directing a projectile into a fluid lubricated deceleration trap chamber unit 82. The funnel generally includes an upper panel 29 and a lower panel 27. The upper panel positioned to define an acute angle b above horizontal h and the lower panel positioned to define an acute angle c below horizontal h. In particular examples, the lower panel 27 may be a dry impact panel 200.

Figure 3C:
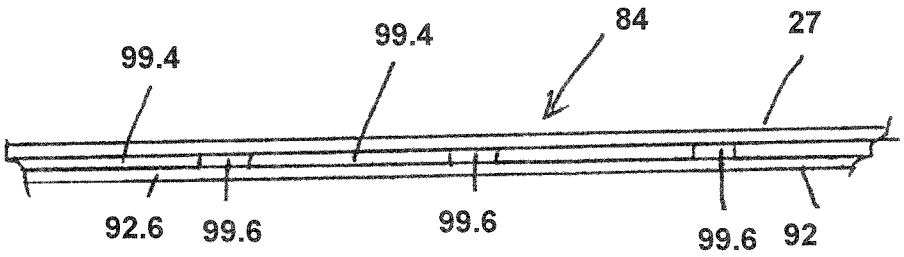
FIG. 3C is an elevation view of the fluid discharge 84.
Figure 3B:
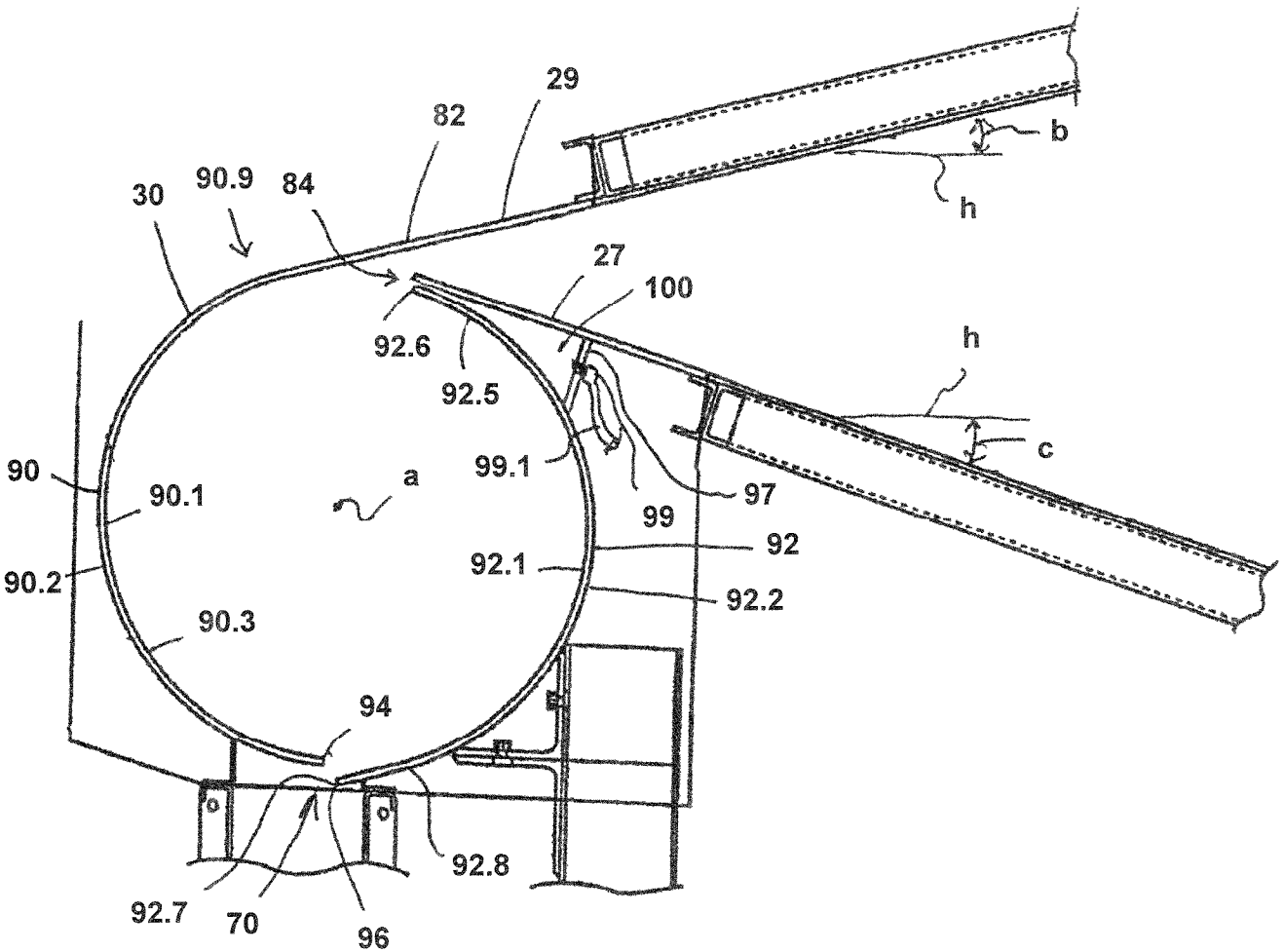
FIG. 3B is an isolated cross-section side view of a lubricated deceleration trap chamber embodiment introduced in FIG. 3A.

Referring to FIGS. 3A and 3B, embodiments of the fluid lubricated deceleration trap chamber unit 82 generally includes a substantially cylindrical chamber 30 with at least one end plate 8. In particular examples, a wet shooting range 80 may include at least two deceleration trap chamber units 82 attached with end plates 8. The chamber 30 may include any of the elements and features shown and described herein, and as shown in FIG. 3A, the chamber 30 has the rearward concave wall 90 with an inner surface 90.1, an outer surface 90.2, and a an upper wall portion 90.9. The chamber also having a forward concave inner wall 92 with an inner surface 92.1, outer surface 92.2, a forward wall upper portion 92.5, a forward wall upper end edge 92.6, a forward wall lower end edge 92.7, and a forward wall lower portion 92.8. Typically, the rearward concave wall 90 has a concave surface 90.3 whereby fluid flow substantially covers the surface. Further, in certain examples the rearward concave wall 90 has a lower portion end edge or end 94 that is spatially offset and separated from end 96 of the forward concave wall 92. As shown, this segmented arrangement may define a splash exit 70, for instance a gravity-fed exit from the chamber 30, and may assist fluid flow along the surfaces. In certain examples, the exit 70 may include a filter system to remove contaminants from the fluid. For instance, the filter system may include a series of weirs to remove heavy particles and/or one, including a plurality, of strainers before any of the fluid is recycled for future lubrication as shown and described herein.

The fluid lubricated deceleration trap chamber unit 82 in each of the projectile trap assemblies may have a common axis a and be substantially perpendicular to the funnel 26, thereby defining a continuous funnel. As shown in FIGS. 3A and 3B, the fluid system having a fluid discharge 84 to coat lower inner surfaces of the chamber 30. For instance, the fluid discharge may wet and lubricate the rearward concave wall 90. The front wall may also be the forward concave wall 92 surfaces to reduce wear at any of the surfaces shown and described herein. Further, the fluid discharge may lubricate the rearward concave wall 90 and a forward concave wall 92 surfaces to reduce a plurality of airborne particles to minimize, or eliminate, environmental impact of the wet shooting range 80.

Referring to FIGS. 3B and 3C, the pressurized fluid containment may comprise the lower panel 27 of the funnel, the forward concave wall 92 of the cylindrical chamber 30, and an end plate 97 with a fitting 99 for connection to a fluid line 99.1. The discharge 84 may comprise the lower panel 27 spaced from the forward concave wall 92 by a gap defined by spacers 99.4 with spray openings 99.6 in between the spacers.

The fluid lubricated deceleration trap chamber unit 82 may include any liquid handling system to provide the lubrication benefits and advantages introduced and illustrated herein. In one example and shown in FIGS. 3A and 3B, the fluid discharge assembly includes at least one pump 101, for pumping fluid to one or a group of adjacent chambers 30. For instance, the pump 101 may drive fluid lubrication to about five or more deceleration trap chambers 30. Further, the fluid system may include a pressurized fluid chamber 100 with the fluid discharge 84, for instance at an upper portion of the fluid deceleration trap chamber to coat interior surfaces. As show in FIG. 3A, a fluid manifold 102 may be in fluid communication with the fluid chamber by a fluid line 104. The fluid discharge assembly may lubricate the inner surfaces of the deceleration trap chamber unit 82 at any suitable volume and at any suitable flow rate. However, Applicants have found unexpected fluid lubrication success when the fluid discharge 84 provides about forty to about fifty gallons per minute, or the like, per about eight foot section chamber 30. Other examples include less than about forty gallons per minute per eight foot section and greater than about fifty gallons per minute per eight foot section. Those of ordinary skill in the art having the benefit of this disclosure will recognize additional fluid flow rates and dimensions for a particular site application.

Figure 4:
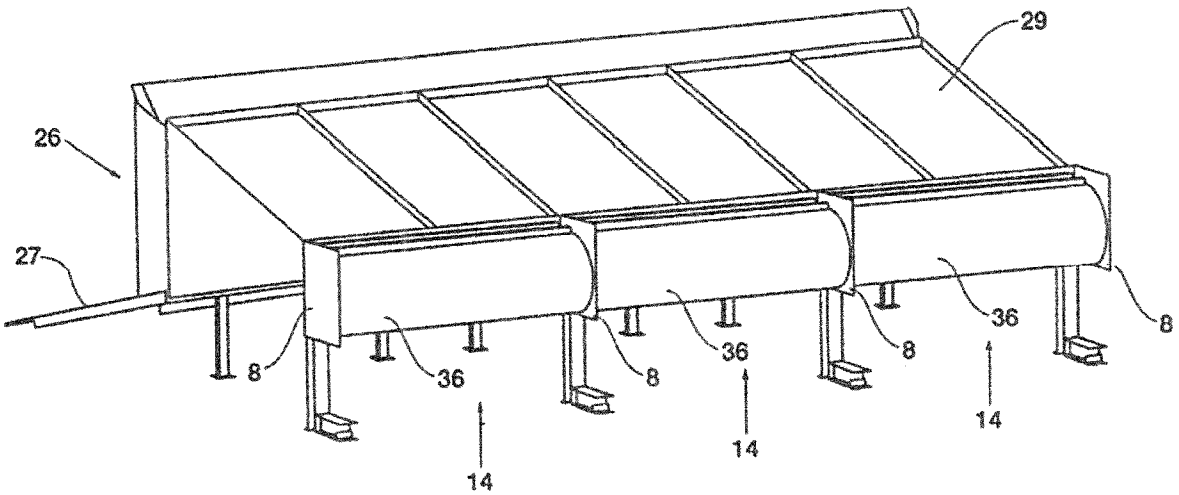
FIG. 4 is an enlarged rear perspective view of a projectile trap embodiment.
Figure 5:
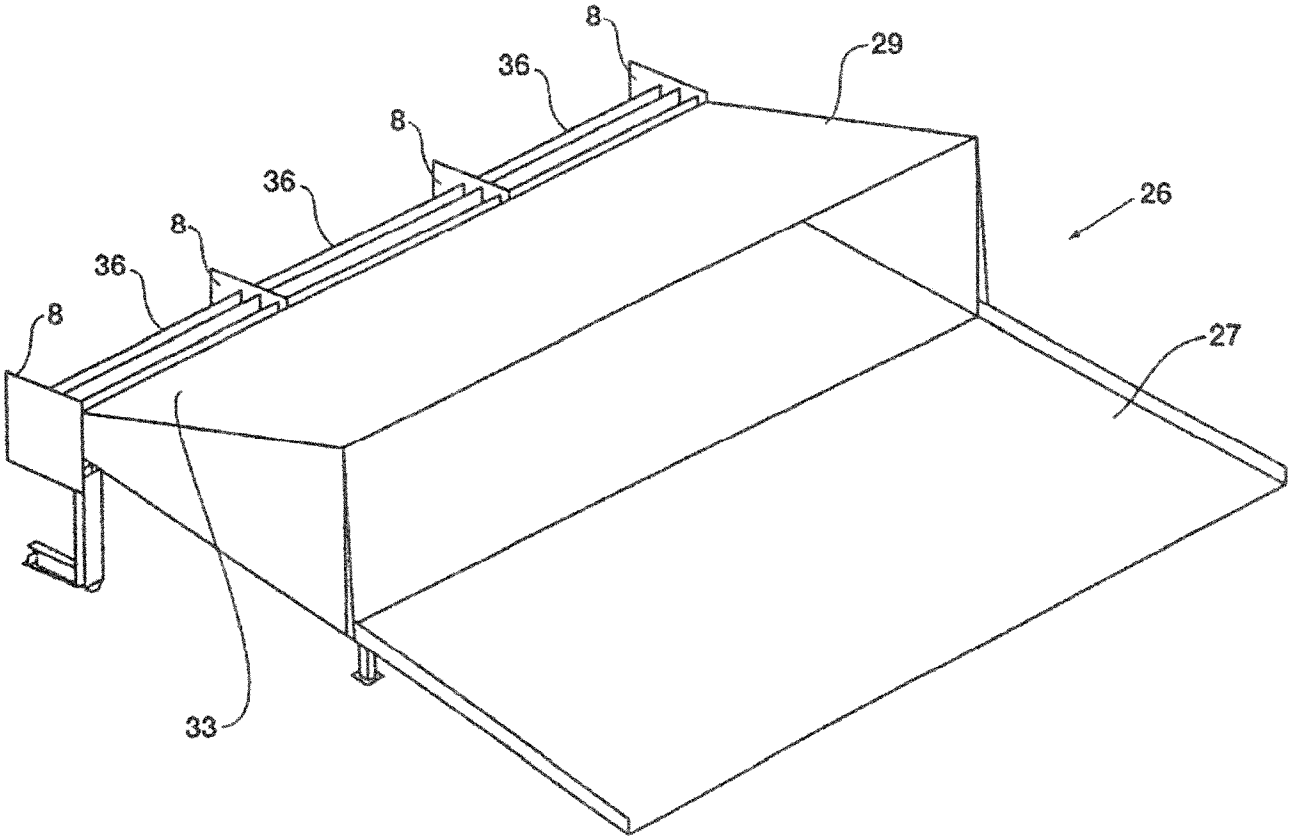
FIG. 5 is an enlarged front perspective view of a projectile trap embodiment.

FIGS. 4 and 5 show perspective views of exemplary embodiments of a series of projectile traps 14, including inner curved surfaces 36 and end plates 8, used in the shooting range of the present inventions. As shown, the end plates 8 on the projectile traps 14 may provide support. In particular, the end plates 8 may provide support at the distal ends of the projectile traps 14.

Certain modifications and improvements may occur to those skilled in the art, upon a reading of the foregoing description. By way of example, while the shooting range shown includes a circular projectile deceleration trap chamber, other types of traps could be used, including, without limitation, the kind having an impact plate design. It should also be apparent that any rounded shape could be used as a projectile trap and the invention is not limited to just circular one sided shapes. Also, the deceleration trap chamber could be made from a series of plates having flat faces, such as shown in U.S. Pat. No. 5,811,718, issued to Bateman. All such modifications and improvements have not been included herein for the sake of conciseness and readability but may properly fall within the scope of the appended claims. Patents incorporated by reference herein for all purposes: U.S. Pat. Nos. 7,434,811; 5,486,008; 5,113,700; and 8,459,651.

Numerous characteristics and advantages have been set forth in the foregoing description, together with details of structure and function. Many of the novel features 5 are pointed out in the appended examples and claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and the include plural referents unless expressly and unequivocally limited to one referent.

The invention claimed is:

1. A shooting range having a plurality of projectile deceleration trap chamber units with a fluid system, each projectile deceleration trap chamber unit comprising:

a forward concave wall and a rearward concave wall defining a chamber, the forward wall having an upper wall end edge and a lower end edge, the rearward concave wall having an upper wall portion and a lower portion end edge, the forward and rearward walls defining an upper bullet entry and a lower slot for de-energized bullets and debris;

a funnel positioned at the top of the chamber for guiding bullets into the upper bullet entry, the funnel having an upper panel member and a lower panel at an acute angle below horizontal;

the lower panel and forward concave wall having a convergence with respect to one another, a fluid outlet positioned at the convergence and the fluid outlet pointing at the inside surface of the rearward wall, the fluid outlet part of the fluid system further including a pump and a fluid reservoir.

2. The shooting range of claim 1 wherein each fluid outlet of each projectile deceleration trap chamber unit is defined by a plurality of metal spacers serially positioned between the lower panel and the forward concave wall and defining a series of outlets between each two adjacent spacers.

3. The shooting range of claim 1, wherein each fluid outlet of each projectile deceleration trap chamber unit lubricates said concave rear inner wall of said deceleration trap chamber.

4. The shooting range according to claim 3, wherein each forward concave wall of each projectile deceleration trap chamber unit is also lubricated by the fluid system.

5. The shooting range of claim 1, wherein said fluid system discharges about forty to about fifty gallons per minute per eight foot section of deceleration trap chamber.

6. The shooting range of claim 1, wherein each lower slot of each projectile trap chamber unit provides a gravity-fed fluid exit.

7. The shooting range of claim 1, further comprising a plurality of targeting systems and one or more sidewalls.

8. The shooting range of claim 1, further comprising a heating ventilation and air conditioning system.

9. The shooting range of claim 1 further comprising an administrative facility having a safety area where firearms may be inspected and readied.

10. A shooting range with a projectile deceleration trap chamber unit with a fluid system, the projectile deceleration trap chamber unit comprising:

a substantially cylindrical chamber with a forward wall and a rearward wall, the chamber having a forward facing upper bullet entry and a lower slot for de-energized bullets and debris;

a funnel positioned at the upper bullet entry, the funnel having an upper panel and a lower panel, each arranged at an acute angle with respect to horizontal;

a fluid system for dispensing fluid into the cylinder at the rearward wall at the upper portion of the cylinder;

wherein the lower wall of the funnel of the projectile deceleration trap chamber unit extends towards the forward wall of the chamber and fluid dispensers are positioned between said lower wall and forward wall for dispensing the fluid into the cylinder.

11. The shooting range of claim 10 wherein the lower slot of the projectile deceleration trap chamber unit opens in a downward and rearward direction.

12. The shooting range of claim 10 wherein the forward wall of the projectile deceleration trap chamber unit also has fluid applied.

13. The shooting range of claim 10 wherein the forward wall and the rearward wall of the projectile deceleration trap chamber unit are both lubricated by fluid from the fluid system.

14. The shooting range of claim 13, wherein each the slot of the projectile trap chamber unit provides a gravity-fed fluid exit.

15. The shooting range of claim 10, further comprising a targeting system.

16. The shooting range of claim 15, further comprising a heating ventilation and air conditioning system.

17. The shooting range of claim 16 further comprising an administrative facility having a safety area where firearms may be inspected and readied.

18. A shooting range having a plurality of projectile deceleration trap chamber units with a fluid system, each projectile deceleration trap chamber unit comprising:

a forward concave wall and a rearward concave wall defining a chamber, the forward wall having an upper wall end edge and a lower end edge, the rearward concave wall having an upper wall portion and a lower portion end edge, the forward and rearward walls defining an upper bullet entry and a lower slot for de-energized bullets and debris;

a funnel positioned at the top of the chamber for guiding bullets into the upper bullet entry, the funnel having an upper panel member and a lower panel at an acute angle below horizontal;

a fluid outlet positioned at or proximate the top of the chamber for lubricating a rearward concave wall surface of the rearward wall, the fluid outlet part of the fluid system and further including a pump and a fluid reservoir;

wherein the fluid outlet of the projectile deceleration trap is positioned between the lower panel member and an upper edge of the forward concave wall.

* * * * *